United States Patent [19]

Oehr

[11] Patent Number: 4,683,038

[45] **Date of Patent: * Jul. 28, 1987**

[54] PROCESS FOR PREPARING CERIC SULPHATE

[75] Inventor: Klaus H. Oehr, Surrey, Canada

[73] Assignee: B.C. Research Council, Vancouver, Canada

[ * ] Notice: The portion of the term of this patent subsequent to Feb. 2, 1999 has been disclaimed.

[21] Appl. No.: 321,085

[22] Filed: Nov. 13, 1981

Related U.S. Application Data

[63] Continuation-in-part of Ser. No. 199,351, Oct. 21, 1980, Pat. No. 4,313,804.

[51] Int. Cl.[4] ..... C25B 1/00

[52] U.S. Cl. ..... 204/93

[58] Field of Search ..... 204/93

[56] References Cited

U.S. PATENT DOCUMENTS

| | | | |
|---|---|---|---|
| 1,202,535 | 10/1916 | Keyes et al. | 204/292 |
| 1,707,450 | 4/1929 | Sommer | 204/93 |
| 1,835,026 | 12/1931 | Driggs | 204/292 |
| 3,413,203 | 11/1968 | MacLean | 204/93 |
| 4,313,804 | 2/1982 | Oehr | 204/93 |

OTHER PUBLICATIONS

Ramaswamy et al., *Bull. Chem. Soc.* (Japan), vol. 35, (1962), pp. 1751–1755.

Kuhn, *The Electrochemistry of Lead,* 1979, p. 251.

Culbertson et al., "The Oxidation of Cerous Sulfate at a Rotating Anode", preprint of the Electrochemical Society, Apr. 20, 1942, pp. 27–32.

*Primary Examiner*—T. Tung

*Attorney, Agent, or Firm*—Beehler, Pavitt, Siegemund, Jagger, Martella & Dawes

[57] ABSTRACT

A process for preparing ceric sulphate in solution. A saturated solution of cerous sulphate is electrolyzed at a high anodic current density in the range 100 to 400 mamp/cm$^2$, high cathode current density in the range 1000 to 4,500 mamp/cm$^2$ and with vigorous agitation in the presence of dilute sulphuric acid. The process permits the production of concentrated ceric sulphate solutions at commercially viable current densities and efficiencies.

7 Claims, No Drawings

PROCESS FOR PREPARING CERIC SULPHATE

CROSS REFERENCE TO RELATED APPLICATION

The present application is a continuation-in-part of my U.S. application Ser. No. 199,351 filed Oct. 21, 1980 now U.S. Pat. No. 4,313,804.

FIELD OF THE INVENTION

This invention relates to a process for preparing ceric sulphate.

DESCRIPTION OF THE PRIOR ART

The use of cerium oxidants, for example ceric sulphate, is well known in organic chemistry. Ceric sulphate can be used to prepare naphthoquinone from naphthalene, p-tolualdehyde from p-xylene and benzaldehyde from toluene.

In preparing a cerium oxidant for use in organic snythesis it is important to prepare the oxidant in as concentrated a form as possible. This is necessary to increase reaction rates and reduce reactor size requirements and manufacturing costs.

Kuhn in the Electrochemistry of Lead published by the Academic Press in 1979, summarizes the prior art in the oxidation of cerium (III) to cerium (IV). It is indicated that prior workers such as Ramaswamy et al, Bull. Chem. Soc. Jap. 35, 1751 (1962), and Ishino et al, Technol. Rep., Osaka University. 10, 261 (1960), have observed that the current efficiency for ceric sulphate production decreases with increasing concentration of sulphuric acid, for example 0.26 to 2.6 molar, and with increasing current density, for example 1 to 3.0 amps/dm$^2$, i.e. 10 to 30 mamp/cm$^2$. The current efficiency of ceric sulphate production was only 54% at an anode current density of 1 amp/dm$^2$ (10 mamp/cm$^2$). The "effective" anode current density was therefore only 5.4 mamp/cm$^2$. Ishino et al. found the best electrolysis conditions to be low anodic current density, for example 2 Amp/dm$^2$ (i.e. 20 mamp/cm$^2$), and low sulphuric acid concentration, for example 0.43 M sulphuric acid.

The prior art fails to reveal how ceric sulphate can be prepared in a concentrated form and at commercially viable current densities, for example 100 mamp/cm$^2$, and commercially viable current efficiencies, for example 50%, to give "effective" anode current densities of 50 mamp/cm$^2$ or higher.

Kuhn, in the above publication, specifically indicates that little information is available for the reaction of oxidizing cerium (III) to cerium (IV).

SUMMARY OF THE INVENTION

However, the present application describes a process able to achieve extremely high current efficiencies for concentrated ceric sulphate preparation and very high effective anode current densities using a wide variety of anodes and cathodes and acid strengths deemed detrimental by others, specifically Ramaswamy et al and Ishino et al.

More specifically, the present invention is a process for preparing ceric sulphate in solution that comprises electrolyzing an at least saturated solution of cerous sulphate at an anodic current density in the range 100 to 400 mamp/cm$^2$, a high cathode current density in the range 1000 to 4,500 mamp/cm$^2$ and with vigorous agitation in the presence of dilute sulphuric acid.

The saturated cerous sulphate may be maintained as such by electrolyzing a suspension of cerous sulphate, or by carrying out the electrolysis of a saturated cerous sulphate solution. A diaphragm is not used. The electrolysis of a saturated cerous sulphate solution is carried out briefly then the electrolyte is mixed with cerous sulphate crystals to resaturate it with respect to cerous sulphate. Undissolved cerous sulphate crystals are allowed to precipitate. The supernatant liquid is then re-electrolyzed.

DESCRIPTION OF THE PREFERRED EMBODIMENTS

The invention is illustrated in the following examples:

EXAMPLES

Except where indicated otherwise in Table 1 electrolysis of a starting electrolyte comprising 25 grams of cerous sulphate pentahydrate, 6.6 ml of concentrated sulphuric acid diluted to a volume of 100 ml with water to give 1M sulphuric acid was carried out with vigorous agitation of the electrolyte during electrolysis. The results and reaction conditions are set out in Table 1. A diaphragm was not used in the electrolysis.

TABLE 1

PREPARATION OF CERIC SULPHATE OXIDANTS

| Anode | Anode Current Density mamp/cm$^2$ | Cathode | Cathode Current Density mamp/cm$^2$ | Anode to Cathode Surface Area | Final Ceric Sulphate Molarity | Temperature °C. | Current Efficiency | Effective Anode Current Density (mamp/cm$^2$) |
|---|---|---|---|---|---|---|---|---|
| Platinum | 300 | Tungsten | 4500 | 15 = 1 | 0.539 | 46-56 | 67.0 | 201 |
| | 300 | Tungsten | 3000 | 10 = 1 | 0.545 | 48-55 | 60.5 | 182 |
| | 200 | Tungsten | 2000 | 10 = 1 | 0.520 | 49-54 | 79.1 | 158 |
| | 400 | Tungsten | 4000 | 10 = 1 | 0.536 | 51-54 | 49.4 | 198 |
| Platinized | 100 | Tungsten | 1000 | 10 = 1 | 0.534 | 51-54 | 81.1 | 81 |
| Titanium | 100 | Tungsten | 2000 | 20 = 1 | 0.517 | 50-54 | 92.0 | 92 |
| | 200 | Tungsten | 3000 | 15 = 1 | 0.553 | 50-56 | 68.1 | 136 |
| | 300 | Tungsten | 4500 | 15 = 1 | 0.532 | 51-56 | 50.7 | 152 |
| | 400 | Tungsten | 4000 | 10 = 1 | 0.525 | 50-56 | 49.8 | 199 |
| Anodized | 200 | Tungsten* | 4000 | 20 = 1 | 0.507 | 51-63 | 76.2 | 152 |
| Lead | 300** | Tungsten | 4500 | 15 = 1 | 0.505 | 49-52 | 55 | 165 |
| | 300 | Tungsten | 3000 | 10 = 1 | 0.51 | 50-54 | 49.4 | 148 |
| | 400 | Tungsten | 4000 | 10 = 1 | 0.50 | 51-56 | 49.1 | 196 |

Electrolyte is 1.2 M $H_2SO_4$ supersaturated with cerous sulphate except experiment marked
**which is electrolyzed cerous sulphate supernatant which has been constantly resaturated.
*includes thin lead deposit generated during anodization of lead in 1.2 M sulphuric acid.

Thus the present invention, like the invention in my U.S. Application Ser. No. 199,351 has illustrated that high current efficiencies obtained at high "effective" current densities and high ceric sulphate concentration when electrolysis is carried out at high anodic and cathodic current densities. Again it is important to maintain the maximum dissolved cerous ion concentration in the electrolyte for the entire electrolysis. With regard to the present process the generally higher molarities of the final ceric sulphate should be noted.

Further information applicable to the present application is:

Cathode current densities much in excess of 4500 mamp/cm$^2$ (e.g. 6000–8000 mamp/cm$^2$) may result in polymerization of ceric sulphate on the cathode due to an excessive hydrogen production rate and increase in pH at the cathode surface. Formation of the polymer can be eliminated by operating in an electrolyte of slightly higher acidity or lower temperature or a combination of both. This polymer can be redissolved from the cathode by exposing it to a mixture of dilute nitric acid and hydrogen peroxide. The polymer can also be dissolved with a mixture of dilute sulphuric acid and hydrogen peroxide.

The significance of operating at high cathode current densities is two fold:

(a) Ceric sulphate exists in the form $H_2Ce(SO_4)_3$ in solution —("sulfatoceric acid") which partially dissociates to form $HCe(SO_4)_3^-$ (anion). This negatively charged anion may be repelled from the negatively charged cathode with increasing cathode current density thereby preventing its decomposition.

(b) The higher the cathode current density, the lower is the cathode surface area and the less likely is any form of ceric ion e.g. $H_2Ce(SO_4)_3$ or $HCe(SO_4)_3^-$, etc. to make contact with the cathode, thereby reducing ceric ion decomposition.

I claim:

1. A process for preparing ceric sulphate in solution that comprises electrolyzing an at least saturated solution of cerous sulphate at an anodic current density in the range 100 to 400 mamp/cm$^2$, a cathode current density in the range 1000 to 4,500 mamp/cm$^2$ and with vigorous agitation in the presence of dilute sulphuric acid.

2. A process as claimed in claim 1 in which the cerous sulphate is electrolyzed as a suspension.

3. A process as claimed in claim 1 in which the cerous sulphate is electrolyzed as a saturated cerous sulphate solution, mixed with cerous sulphate crystals to resaturate it with respect to cerous sulphate after brief electrolysis, allowing undissolved cerous sulphate crystals to precipitate and electrolyzing the supernatant, saturated cerous sulphate.

4. A process as claimed in claim 1 in which the electrolyte temperature is in the range 40° C. to 60° C.

5. A process as claimed in claim 1 in which the anode used in the electrolysis is selected from electroplated platinized titanium, platinum and anodized lead.

6. A process as claimed in claim 1 in which the dilute sulphuric acid is one to two molar.

7. A process as claimed in claim 1 in which the cathode used in the electrolysis is made from tungsten.

* * * * *